United States Patent [19]

Huang et al.

[11] Patent Number: 5,065,821

[45] Date of Patent: Nov. 19, 1991

[54] GAS FLOODING WITH HORIZONTAL AND VERTICAL WELLS

[75] Inventors: Wann-Sheng Huang, Houston; Jack J. Hsu, Stafford, both of Tex.

[73] Assignee: Texaco Inc., White Plains, N.Y.

[21] Appl. No.: 463,704

[22] Filed: Jan. 11, 1990

[51] Int. Cl.[5] ..... E21B 43/00

[52] U.S. Cl. ..... 166/245; 166/50; 166/263; 166/269; 166/303

[58] Field of Search ..... 166/263, 245, 268, 269, 166/50, 272, 303

[56] References Cited

U.S. PATENT DOCUMENTS

| | | | |
|---|---|---|---|
| 3,672,448 | 6/1972 | Hoyt | 166/245 |
| 4,390,067 | 6/1983 | Willman | 166/272 |
| 4,418,753 | 12/1983 | Morel et al. | 166/268 |
| 4,466,485 | 8/1984 | Shu | 166/272 |
| 4,535,845 | 8/1985 | Brown et al. | 166/272 |
| 4,637,461 | 1/1987 | Hight | 166/50 |
| 4,645,003 | 2/1987 | Huang et al. | 166/50 |
| 4,646,824 | 3/1987 | Huang et al. | 166/50 |
| 4,662,441 | 4/1987 | Huang et al. | 166/50 |
| 4,682,652 | 7/1987 | Huang et al. | 166/50 |
| 4,685,515 | 8/1987 | Huang et al. | 166/50 |
| 4,702,314 | 10/1987 | Huang et al. | 166/50 |
| 4,718,485 | 1/1988 | Brown et al. | 166/50 |
| 4,727,937 | 3/1988 | Shum et al. | 166/245 |

*Primary Examiner*—Ramon S. Britts
*Assistant Examiner*—Roger J. Schoeppel
*Attorney, Agent, or Firm*—Jack H. Park; Kenneth R. Priem; Harold J. Delhommer

[57] ABSTRACT

The invention is a method of producing hydrocarbons from a region bounded by two vertical wells and a horizontal well, which comprises injecting a gas through a first vertical well, concurrently performing a cyclic injection, soak and production of gas through a horizontal well, converting the first well to production after the gas injected from the first well reaches the area affected by gas from the horizontal well, and injecting gas through a second vertical well.

8 Claims, 1 Drawing Sheet

GAS FLOODING WITH HORIZONTAL AND VERTICAL WELLS

BACKGROUND OF THE INVENTION

The invention process is concerned with the enhanced recovery of oil from underground formations. More particularly, the invention relates to a method for producing hydrocarbons with a combination drive and cyclic gas injection scheme to efficiently sweep the portion of a formation bounded by two vertical wells and a horizontal well.

Horizontal wells have been investigated and tested for oil recovery for quite some time. Although horizontal wells may in the future be proven economically successful to recover petroleum from many types of formations, at present, the use of horizontal wells is usually limited to formations containing highly viscous crude. It seems likely that horizontal wells will soon become a chief method of producing tar sand formations and other highly viscous oils which cannot be efficiently produced by conventional methods because of their high viscosity.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

U.S. Pat. No. 4,283,088 illustrates the use of a system of radial horizontal wells, optionally in conjunction with an inverted 9 spot having an unusually large number of injection wells. U.S. Pat. No. 4,390,067 illustrates a scheme of using horizontal and vertical wells together to form a pentagonal shaped pattern which is labeled a "5 spot" in the patent, although the art recognizes a different pattern as constituting a 5 spot. Various combinations of vertical and horizontal wells are disclosed in U.S. Pat. Nos. 4,637,461; 4,645,003; 4,646,824; 4,662,441; 4,685,515, 4,702,314; 4,718,485 and 4,727,937.

U.S. Pat. No. 4,535,845 discloses a method for sweeping a portion of a formation with steam that is bounded by two vertical wells and a horizontal well. In this method, the vertical and horizontal wells are perforated throughout the hydrocarbon zone and steam is continuously injected through the first vertical well and the horizontal well. The process sweeps hydrocarbons through the formation and produces hydrocarbons only at the second vertical well.

A thermal fluid method of producing hydrocarbons bounded by two vertical wells and a horizontal well is disclosed in U.S. Pat. No. 4,682,652. In this invention, a thermal fluid is injected into the formation through the first vertical well. Hydrocarbons and other fluids are produced from the horizontal well located between the two vertical wells through a first perforated interval in the horizontal well located near the first vertical well. After depleting this area of the formation, the first perforated interval is closed off and the process is repeated for successively perforated intervals of the horizontal well, all of which are farther from the first vertical well than the preceding perforated intervals. Near the end of the process, production is taken through the second vertical well. An alternate embodiment discloses a cyclic injection, soak and production of thermal fluid through the horizontal well or the first vertical well prior to initiating the process.

SUMMARY OF THE INVENTION

The invention is a method of producing hydrocarbons from a portion of an underground formation bounded by at least one substantially vertical well and at least one well having both a vertical wellbore and a horizontal wellbore. The combination well having vertical and horizontal wellbores may be replaced in the practice of the invention by separate vertical and horizontal wells.

The process is initiated by injecting a gas into the formation through a first substantially vertical injection well. Concurrently with the gas injection through the first vertical injection well, a huff-puff or cyclic injection, soak and production of gas is made through a horizontal wellbore of the combination vertical and horizontal well. The horizontal wellbore must extend from the vertical wellbore of the combination well or from relatively near a second vertical well, about one-third to about two-thirds of the distance to the first substantially vertical injection well.

After the gas injected through the first substantially vertical injection well reaches the portion of the formation affected by the gas injected and produced through the horizontal wellbore, the first substantially vertical injection well is converted to a production well. A production pump is set relatively near the bottom of the producing zone in the first production well. Gas is injected continuously through perforations near the bottom of the vertical wellbore in the vertical wellbore or second vertical well and gas and hydrocarbons are produced from the first substantially vertical production well.

DETAILED DESCRIPTION

Figure 1:
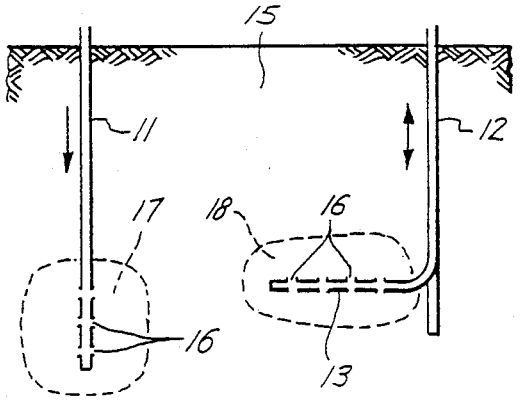
FIGS. 1–3 are sectional views of an underground formation illustrating the successive steps of the invention with a first vertical well and a combination horizontal and vertical well.

Although they are more costly and difficult to drill, horizontal wells offer several advantages over vertical wells. One advantage is the increase in direct contact between the wellbore and the pay zone. The perforated interval per vertical well is limited to the pay zone thickness. But for a horizontal well, the perforated interval could be more than ten times that of a vertical wellbore. For example, a 400 foot horizontal well could be run in a 30 foot thick pay zone.

A second advantage of horizontal wells is the ability to complete several horizontal wells from a single location and cover a large drainage area. This is an important advantage when drilling in offshore, arctic or environmentally sensitive areas where drill site preparation is a major expense.

Third, vertical drilling can be uneconomical in very thin pay zone areas. Properly placed horizontal wells can solve this problem. For certain thin formations with a bottom water table, horizontal wells could defer and reduce water coning by providing a low pressure area over a long distance rather than a single low pressure point as with vertical wells.

A fourth advantage is the ability to inject or produce fluids orthogonal to those from a vertical well. This provides the potential of improving the sweep efficiency of a flood, and therefore increasing recovery efficiency.

On the negative side, horizontal wells are significantly more expensive to drill than vertical wells. However, all existing hydrocarbon reservoirs have vertical wells which have already been drilled in the reservoirs. Thus, ways must be found to coordinate the use of horizontal wells with existing vertical well patterns.

A vertical well may also be converted with existing technology to a horizontal well by the addition of a horizontal wellbore or horizontal drain-hole to the vertical well. It is now possible to drill at a sharp turning angle so that a substantially horizontal wellbore can be drilled within a distance of two to four feet from the vertical wellbore. This horizontal wellbore or drain hole may be drilled from the side or bottom of a vertical wellbore. The present invention requires the use of two substantially vertical wells and a horizontal well running from the vicinity of the second vertical well about one-third to two-thirds of the distance to the first vertical well. A combination well having a vertical and horizontal wellbore may be substituted for the second vertical well and the horizontal well to achieve substantially the same results.

The invention method provides a way of achieving certain horizontal well advantages in conjunction with the use of vertical wells by gas injection process which offers substantial hydrocarbon recovery. The first step is injecting a gas into the formation through the first substantially vertical injection well. A huff-puff or cyclic gas injection, soak and production is performed through the horizontal wellbore concurrently with the gas injection through the first vertical injection well. The horizontal wellbore extends from the near vicinity of the second vertical well or wellbore and runs about one-third to about two-thirds, preferably about one-half, of the distance to the first substantially vertical injection well.

The huff-puff or cyclic gas injection and production through the horizontal wellbore is a flexible step. It may be performed once or multiple times. The soak time and the quantity of gas injected into the formation may be varied substantially according to the type of formation and the desire of the operator.

After the gas injected through the first substantially vertical injection well reaches the portion of the formation affected by the cyclic injection and production through the horizontal wellbore, the first substantially vertical injection well is converted to a first substantially vertical production well. In practice, there is no exact time when the vertical injection well is converted to a production well and the next process step begun. There may or may not be an overlap between the vertical well fluid injection zone and the horizontal well cyclic injection zone.

A production pump is set relatively near the bottom of the pay zone of the first production well and gas is continuously injected through the perforations in the vertical wellbore of the combination well or the second vertical well. It is preferred, but not necessary that the gas injection through the second substantially vertical well be made through perforations relatively near the bottom of the pay zone in the second vertical well. It is preferred that gas be injected only through the second vertical well or wellbore in this step, but gas may be optionally injected through the horizontal wellbore at the same time. Production of gas and hydrocarbons is made through the first substantially vertical production well.

The invention method is applicable for any gas used for flooding. Most preferably, the injected gas would be carbon dioxide or nitrogen, but may also be a low molecular weight hydrocarbon having about one to five carbon atoms such as methane through pentane. The gas may be miscible, conditionally miscible, or immiscible under formation conditions with the underground hydrocarbon.

The horizontal wells should be drilled in the bottom third, most preferably the bottom fifth, of the hydrocarbon formation to take full advantage of horizontal well production properties. Generally, injection through the first vertical well will take place throughout the entire hydrocarbon interval, unless the characteristics of the formation suggest the advantages of a different method of completion, or unless the formation is unusually thick, such as in some tar formations.

The cyclic gas injection and production through the horizontal well may have varied soak times. The gas is preferably allowed to soak in the formation for about 1 day to about 20 days prior to producing fluids through the horizontal well. The huff-puff cycle may be repeated multiple times.

The size of the slugs of injected gas may vary according to several factors, chief among these being the type of gas employed, the characteristics of the hydrocarbon formation, the oil contained therein, the depth of gas penetration desired into the near wellbore area, and the location of the wells relative to each other, as well as other factors.

In many hydrocarbon formations, there are a substantial number of existing vertical wells. To practice the invention, it is only necessary to drill a horizontal well between pairs of vertical wells or to drill a horizontal wellbore from an existing vertical well. The first and second vertical wells described herein could represent an injector and a producer pair, or two vertical wells in a 5-spot, 7-spot, 9-spot or any other pattern configuration.

The invention may also be practiced by shutting off all production through the horizontal wellbore or all injection through the horizontal wellbore while injecting through the second substantially vertical wellbore. This may be done in several ways. One method is to use a sliding sleeve arrangement inside the casing to close off the perforations. A second method is to fill in the borehole with cement where it is desired to close off the perforations, and recomplete the well by perforating through the cement. A third method is to inject some chemical compound through the perforations to close off the formation near those perforations.

Figure 4:
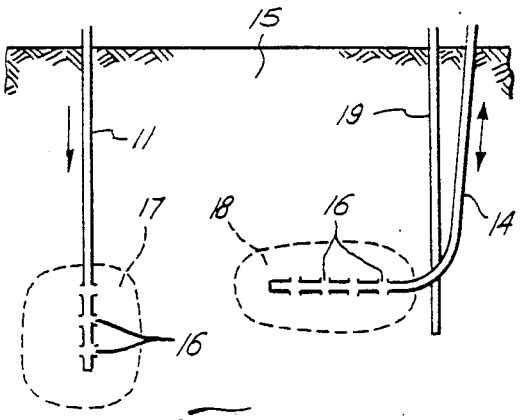
FIGS. 4–6 are sectional views of an underground formation illustrating the successive steps of the invention with two vertical wells and a horizontal well.
Figure 2:
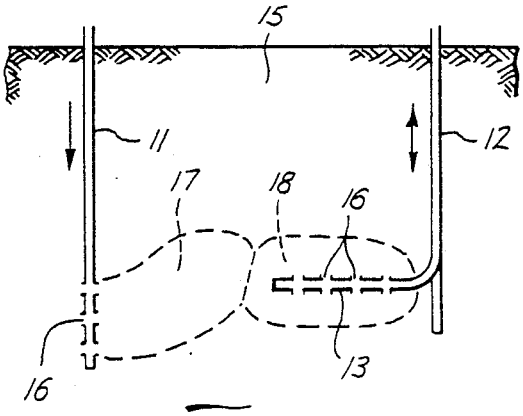
Figure 5:
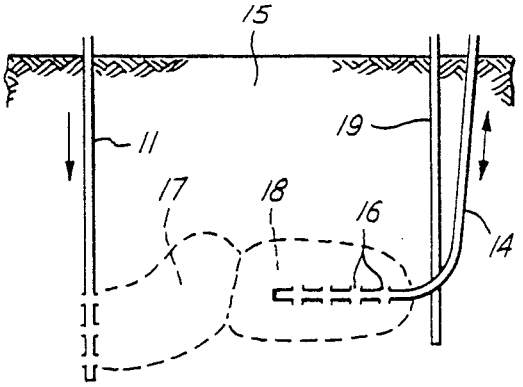
Figure 3:
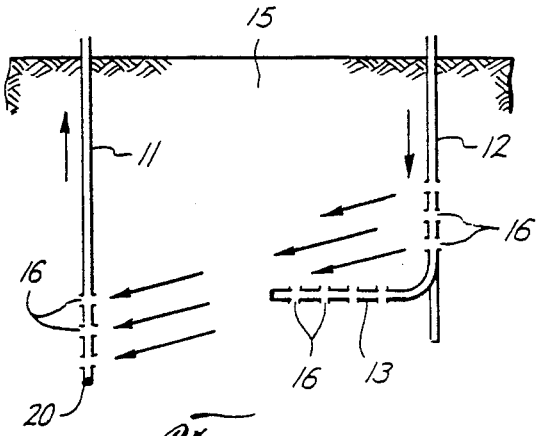
Figure 6:
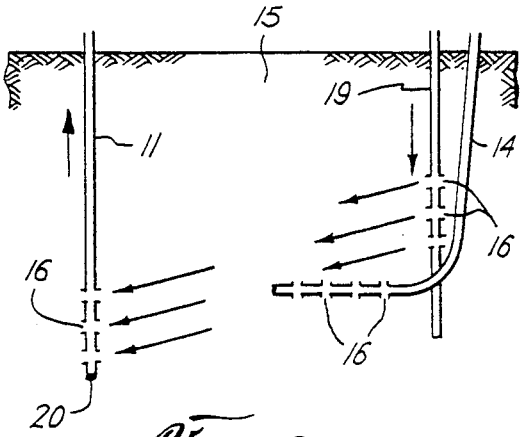

FIGS. 1–6 illustrate the practice of the invention according to the successive steps disclosed herein. FIGS. 1–3 illustrate the invention practice with a first vertical well and a combination well having vertical and horizontal wellbores. FIGS. 4–6 illustrate the practice of the invention with two vertical wells and a horizontal well penetrating the underground formation.

In FIGS. 1–6, vertical well 11 and combination well having vertical borehole 12 and horizontal borehole 13 are illustrated penetrating the underground formation 15. Second vertical well 19 and horizontal well 14 are also illustrated in the underground formation 15 in FIGS. 4–6. Perforations in horizontal and vertical wellbores are indicated at 16. The area 17 bounded by dashed lines illustrates the extent of the fluid injected through vertical injection well 11. The area 18 bounded by dashed lines indicates the area of the formation affected by fluid injected through horizontal wellbore 13 or horizontal well 14. A production pump 20 is indicated at the bottom of the first vertical well in FIGS. 3 and 6.

FIG. 1 illustrates the injection of fluid through vertical well 11 expanding through t he formation in area 17 and the cyclic injection and production of fluid through horizontal wellbore 13 of the combination well into area 18 of the formation 15. As shown in FIG. 2, continuing fluid injection through vertical injection well 11 enlarges the area 17, and cyclic injection and production through horizontal wellbore 13 enlarges area 18 in the underground formation 15. Please note that only one side (one half) of the area 17 in FIGS. 2 and 5 has been illustrated. The area 17 outside of the boundaries of the two vertical wells in FIGS. 2 and 5 has been omitted from the figures.

Once the areas 17 and 18 meet, vertical injection well 11 is converted to a vertical production well 11 with the setting of production pump 20 at the bottom of the pay zone and fluid is injected through perforations 16 of the vertical wellbore 12 as illustrated in FIG. 3 or perforations 16 of vertical well 19 of FIG. 6. The same procedure is followed for FIGS. 4–6 except that separate horizontal well 14 substitutes for the horizontal wellbore 13 of FIGS. 1–3.

Horizontal wells primarily extend from the surface and run a substantially horizontal distance within the hydrocarbon formation. Usually, the horizontal well is spudded into the substrate in such a manner as to approach the overburden layer either vertically, or at an angle. Thereafter, as the wellbore enters and penetrates the hydrocarbon formation, it is diverted into a substantially horizontal direction. Preferably, the wellbore will be urged in a direction so that it will run parallel within the productive hydrocarbon layer. Recent technological advances have even made it possible to drill a horizontal well through and from a previously existing vertical well. Thus, the term horizontal well as used herein refers to any well which runs in a substantially horizontal direction within a hydrocarbon formation, regardless of the type or origin of the horizontal well.

The diameter and length of the horizontal wells and their perforation intervals are not critical, except that such factors will affect the well spacing and the economics of the process. Perforation size will be a function of factors such as flow rate, temperatures and pressures employed in a given operation. Such decisions should be determined by conventional drilling criteria, the characteristics of the specific formation, the economics of a given situation, and the well known art of drilling horizontal wells.

Because of the well known tendency of gas to rise in a formation and create gas override zones, the use of this invention method will substantially reduce gas override zones. The entire reservoir will be swept more efficiently.

Many variations of the method of this invention will be apparent to those skilled in the art from the foregoing discussion and examples. Variations can be made without departing from the scope and spirit of the following claims.

What is claimed is:

1. A method of producing hydrocarbons from a portion of an underground formation bounded by at least one substantially vertical well and at least one well having both a vertical wellbore and a horizontal wellbore, comprising:

injecting a gas into the formation through a first substantially vertical injection well;

performing concurrently with the gas injection through the vertical injection well at least one cycle of gas injection, soak, and production through a horizontal wellbore of a combination vertical and horizontal well;

said horizontal wellbore extending from the vertical wellbore of the combination well about one-third to about two-thirds of the distance to the first substantially vertical injection well;

after the gas injected through the first substantially vertical injection well reaches the portion of the formation affected by the gas injected and produced through the horizontal wellbore, converting the first substantially vertical injection well to a first substantially vertical production well;

setting a production pump relatively near the bottom of the first production well;

injecting gas continuously through perforations in the vertical wellbore of the combination vertical and horizontal well relatively near the bottom of the vertical wellbore; and producing gas and hydrocarbons from the first substantially vertical production well.

2. The method of claim 1, wherein the gas is miscible with the formation hydrocarbons.

3. The method of claim 1, wherein the gas is immiscible with the formation of hydrocarbons.

4. The method of claim 1, wherein the gas is carbon dioxide, nitrogen, methane, ethane, propane, butane, pentane, or a mixture thereof.

5. The method of claim 1, further comprising closing off the perforations in the horizontal wellbore when injecting gas through the vertical wellbore.

6. The method of claim 1, further comprising shutting off all production through the vertical wellbore of the combination vertical and horizontal well.

7. The method of claim 1, wherein the first vertical well and the vertical wellbore of the combination well are two vertical wells in a five-spot, seven-spot, nine-spot, or 13-spot well pattern.

8. A method of producing hydrocarbons from a portion of an underground formation bounded by at least two substantially vertical wells and a substantially horizontal well between the two substantially vertical wells, comprising:

injecting a gas into the formation through a first substantially vertical injection well;

performing at least one cycle of gas injection, soak, and production concurrently with the gas injection through the first substantially vertical injection well through a substantially horizontal well;

said horizontal well extending from the vicinity of a second substantially vertical well about one-third to about two-thirds of the distance to the first substantially vertical injection well;

after the gas injected through the first vertical injection well reaches the portion of the formation affected by the gas injected and produced through the horizontal well, converting the first vertical injection well to a first production well;

setting a production pump relatively near the bottom of the first production well;

injecting gas continuously through perforations in the second vertical well relatively near the bottom of the well; and producing gas and hydrocarbons from the first substantially vertical production well.

* * * * *